US008240384B2

(12) United States Patent
Miller et al.

(10) Patent No.: US 8,240,384 B2
(45) Date of Patent: Aug. 14, 2012

(54) FORMING STRUCTURES IN A WELL IN-SITU

(75) Inventors: Todd B. Miller, Carrollton, TX (US); Syed Hamid, Dallas, TX (US); Juanita M. Cassidy, Duncan, OK (US); Donald G. Kyle, The Colony, TX (US); Pete Clement Dagenais, The Colony, TX (US); Michael L. Fripp, Carrollton, TX (US); Ashok Santra, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 356 days.

(21) Appl. No.: 12/570,271

(22) Filed: Sep. 30, 2009

(65) Prior Publication Data

US 2011/0073307 A1 Mar. 31, 2011

(51) Int. Cl.
*E21B 33/12* (2006.01)
*E21B 33/13* (2006.01)
*E21B 33/134* (2006.01)

(52) U.S. Cl. ..... 166/285; 166/65.1; 166/66.5; 166/192; 166/244.1; 166/300; 166/376; 166/381

(58) Field of Classification Search ..... None
See application file for complete search history.

(56) References Cited

U.S. PATENT DOCUMENTS

| | | | | |
|---|---|---|---|---|
| 1,784,214 | A * | 12/1930 | Workman | 166/248 |
| 2,099,328 | A * | 11/1937 | Casagrande | 205/766 |
| 2,118,669 | A * | 5/1938 | Grebe | 166/248 |
| 2,321,138 | A * | 6/1943 | Grebe et al. | 166/248 |
| 2,696,260 | A * | 12/1954 | Fast | 166/66.5 |
| 4,246,075 | A | 1/1981 | Hilbertz | |
| 4,440,605 | A | 4/1984 | Hilbertz | |
| 4,507,177 | A | 3/1985 | Duckworth et al. | |
| 5,252,266 | A | 10/1993 | Brabston et al. | |
| 5,722,479 | A | 3/1998 | Oeftering | |
| 5,836,390 | A | 11/1998 | Apps et al. | |
| 6,253,847 | B1 * | 7/2001 | Stephenson | 166/248 |
| 7,699,101 | B2 * | 4/2010 | Fripp et al. | 166/229 |
| 2004/0084184 | A1 * | 5/2004 | Orban et al. | 166/292 |
| 2007/0256828 | A1 * | 11/2007 | Birchak et al. | 166/249 |
| 2008/0135249 | A1 * | 6/2008 | Fripp et al. | 166/285 |

FOREIGN PATENT DOCUMENTS

GB 656754 8/1951

(Continued)

OTHER PUBLICATIONS

"Grow Your Own Buildings," www.motherearthnews.com, Mar./Apr. 1980, found at http://www.motherearthnews.com/print-article.aspx?id=67102, last visited Jan. 18, 2010 (2 pages).

(Continued)

*Primary Examiner* — George Suchfield
(74) *Attorney, Agent, or Firm* — Fish & Richardson P.C.

(57) ABSTRACT

Structures can be formed downhole by accumulating already existing materials and/or materials introduced into a well to perform a specified function. The formed structures may be used to obstruct fluid flow of production or injection fluids, carry mechanical loads, control electrical or magnetic properties of components, mechanically actuate a component, as well as others. The materials may be induced to form the specified structure, such as by application of a potential downhole. For example, electrical, magnetic, sonic, biological potentials, or a combination thereof may be established downhole to form specified structures in specified locations to perform specified functions.

30 Claims, 11 Drawing Sheets

FOREIGN PATENT DOCUMENTS

| | | |
|---|---|---|
| GB | 663850 | 12/1951 |
| GB | 2129015 A | 5/1984 |

OTHER PUBLICATIONS

"Coral Process," www.wolfhilbertz.com, found at http://www.wolfhilbertz.com/accretion.html, last visited Jan. 18, 2010 (2 pages).

"Electrodeposition of Minerals in Sea Water: Experiments and Applications," Wolf H. Hilbertz, IEEE Journal on Oceanic Engineering, vol. OE-4, No. 3, Jul. 1979 (19 pages).

"Electro-Accretion: Grow Shelters from Sea Minerals," Wolf H. Hilbertz, 1987 (1 page).

* cited by examiner

FORMING STRUCTURES IN A WELL IN-SITU

TECHNICAL FIELD

This invention relates to accumulating material downhole in a specified manner, e.g., to form a specified structure and/or to perform a specified function.

BACKGROUND

Downhole operations, e.g., drilling, completion, production, or treatment, pose challenges due to the remoteness of a well from the terrestrial surface as well as the confined space within the well. These challenges, as well as others associated with drilling and production of subterranean resources, can involve expensive and time-consuming efforts when problems arise downhole, such as intrusion of water into a portion of the well. For example, to correct a problem downhole, production may have to be suspended, tools removed from the well, and additional treatments applied to the well (e.g., introduction of additional tools or substances into the well), each with an associated large expenditure of time and resources.

Further, the development of problems downhole within a well can further lead to reduced resource production. For example, water may accumulate in an articulated portion of the well (i.e., heel portion), thereby reducing or preventing production from other portions of the well downhole from the first portion.

SUMMARY

In one embodiment, a method includes applying a powered signal within a well; and accreting material at a specified location in response to the powered signal. In some embodiments, the method may further include introducing the material or one or more components thereof into the well. In some aspects, accreting material at the specified location may include forming a structure at the specified location. Forming the structure at the specified location may also include occluding an opening. Forming the structure at the specified location may also include forming a restriction to flow. In certain aspects, forming a barrier to flow may include positioning a porous member within a tubular; and changing a porosity of the porous member. Further, in some aspects, forming a structure at the specified location may include disposing a starter form at the specified location; and accumulating material onto the starter form. In some embodiments, accreting material at a specified location in response to the powered signal may include accreting dissolved materials naturally occurring within the well.

In some embodiments, the method may further include disposing a first element at a first position downhole and disposing a second element at a second position downhole, where accreting material at a specified location in response to the powered signal may include dissolving at least a portion of the second element; and depositing the dissolved portion of the second element onto the first element. The method may further include removing the accreted material from the specified location by reversing polarity of the applied powered signal to cause the accreted material to dissolve. In some embodiments, the method may further include removing the accreted material from the specified location by introducing a material within the well to dissociate the accreted material. In some instances, accreting material at a specified location in response to the powered signal may include accreting material from a sacrificial material.

In some specific embodiments, the method may further include disposing a plurality of different sacrificial materials downhole; and selectively applying the powered signal to one or more of the different sacrificial materials to form a layer of accreted material corresponding thereto. Selectively applying the powered signal to one or more of the different sacrificial materials to form a layer of accreted material corresponding thereto may include applying a different powered signal to each of the selected one or more different sacrificial materials. In some aspects, applying a powered signal within a well may include generating one of an electric potential, a magnetic field, or a sonic signal at a location within the well. In certain aspects, accreting material at a specified location in response to the powered signal may include accreting the material to an amount to cause actuation of a mechanism downhole.

In another general embodiments, a method for forming a structure downhole in a well includes generating an electric potential at a specified location downhole within the well causing deposition of dissolved solids at the location. In some specific embodiments, generating an electric potential at a location downhole within the well causing deposition of dissolved solids at the location may include accumulating the dissolved solids dispersed within a downhole liquid. The method may further include introducing one or more materials into the well to form the dissolved solids in response to the generated electric potential. In some aspects, introducing one or more materials into the well to form the dissolved solids in response to the generated electrical potential may include positioning an object formed from a sacrificial material in the well, the sacrificial material forming the dissolved solids in response to the electric potential.

In some specific aspects, positioning an object formed from a sacrificial material in the well may include positioning a first member adjacent a second member, where the first member forms an negative electrode and the second member forming a positive electrode; and generating the electric potential between the positive electrode and negative electrode. In some aspects, generating an electric potential at a location downhole within the well causing deposition of dissolved solids at the location within the well may include occluding an opening downhole with the dissolved solids. The method may further include actuating a mechanism downhole with the deposited solids.

In another general embodiments, a method includes forming an electric potential across a gap at a specified location within a well, where the gap is immersed in a liquid containing dissolved solids; and accumulating the dissolved solids at the specified location in response to the electric potential to form a structure. In some aspects, accumulating the dissolved solids at a location in response to the electric potential to form a structure may include accumulating the dissolved solids to occlude an opening to at least one of reduce or preclude fluid passage therethrough. In some aspects, accumulating the dissolved solids at a location in response to the electric potential to form a structure may include forming a coating over a portion of an object disposed downhole. The method may further include actuating a downhole mechanism with the formed structure.

The details of one or more implementations are set forth in the accompanying drawings and the description below. Other features, objects, and advantages will be apparent from the description and drawings, and from the claims.

DETAILED DESCRIPTION

The present disclosure relates to forming structures downhole by accumulating already existing materials and/or materials introduced into a well to perform a specified function. For example, the formed structures may be used to obstruct fluid flow of production or injection fluids, carry mechanical loads, control electrical, thermal, or magnetic properties of components, mechanically actuate a component, as well as others. The materials may be induced to form the specified structure, such as by application of a potential downhole. For example, electrical, magnetic, sonic, or even biological potentials may be established downhole to form specified structures in specified locations to perform specified functions.

In many wells, water is usually present therein due to the presence of water in one or more subterranean formations intersected by the well. Dissolved in the water may be any number of different types of dissolved substances, e.g., minerals and compounds. The dissolved substances, such as salts, metals, bacteria, as well as other materials, may be induced to form structures to perform specified functions. A particularly desirable function involves conformance control, also referred to as control of water downhole. In typical applications, formation of specified structures may be accomplished where the water has a similar mineral content as that of sea water. For example, a location downhole that interfaces with water having a sufficient mineral content may be used as a nucleation site for a specified structure.

Figure 1:
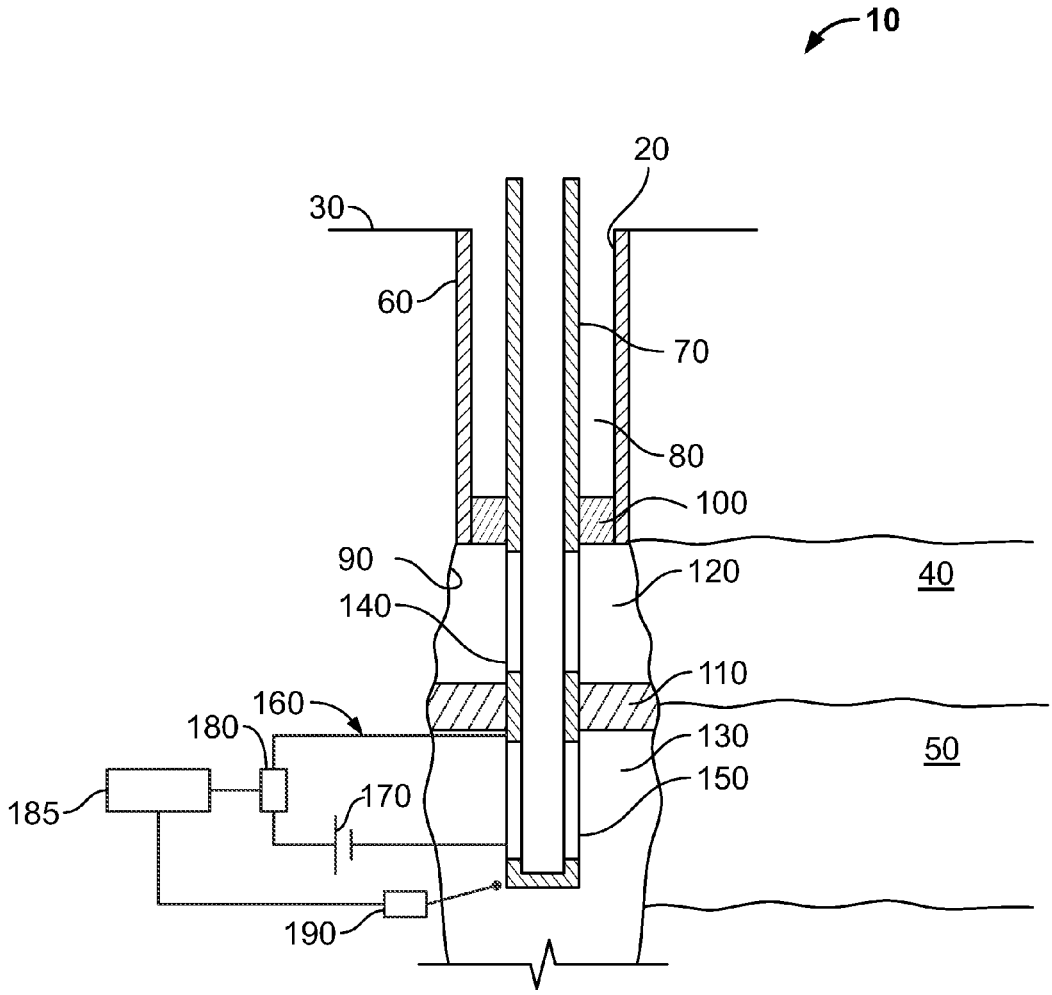
FIG. 1 shows an example well.

In one implementation, some substances contained in the water downhole may be made to react and precipitate out or form other materials. These precipitates may also be made to deposit at specified locations in the well. For example, in some implementations, accretion using electrolysis may be used to form the specified structures. Referring to FIG. 1, a completed well 10 is shown. Although discussed with respect to a well, the formation of structures in the manner described is not so limited but may also be applicable to a well in different states, e.g., during drilling, completion, one or more well treatments, etc.

As shown, the well 10 includes a well bore 20 extending from a terranean surface 30 into subterranean zones 40 and 50. In some implementations, the well bore 20 may extend into additional or fewer subterranean zones. A portion of the well bore 20 may be lined with a casing 60. A tubing string 70 extends through the well bore 20 forming an annulus 80 between the casing 60 and/or an interior surface 90 of the well bore 20 and the tubing string 70. Packers 100, 110 are disposed in the annulus 80 to isolate portions of the annulus 80. Additional or fewer packers may also be used. As shown, the packers 100, 110 are used to isolate portions 120 and 130 of the well bore 20 adjacent subterranean zones 40 and 50, respectively.

The tubing string 70 may also include screens 140 and 150 in the isolated well portions 120, 130. Water may be captured within the well bore 20 such that at least a portion of the screens 140 and/or 150 are in contact with or partially or fully submerged in the water. The screens may function to prevent passage of debris contained in the production fluids (produced from the subterranean zones 40 and 50) into the tubing string 70. In the illustrated example, the subterranean zone 40 may produce petroleum with little or no water entrained therein while subterranean zone 50 may produce a petroleum and water mixture. Although the well shown in FIG. 1 is illustrated as a vertical well, the disclosure is applicable to other types of wells and well systems, including articulated wells or well systems having articulated wells, or horizontal wells or well systems including horizontal wells.

The well 10 also includes a structure formation system 160. In the illustrated example, the structure formation system 160 includes a power source 170 for generating a voltage, a switch 180 for activating or deactivating the power source 170, a controller 185 for controlling application of the generated voltage, and a sensor 190 for monitoring formation of the specified structure. The structure formation system 160 is coupled to the screen 150. In some implementations, the structure formation system 160 may include additional or fewer elements. For example, in some implementations, the structure formation system 160 may include only a power source 170 while others may also include a switch, such as switch 180. Further, in other implementations, the structure formation system 160 may be coupled to both the screens 140 and 150 or only to screen 150. In still other implementations, separate structure formation systems may be coupled to the screens 140 and 150.

Figure 2A:
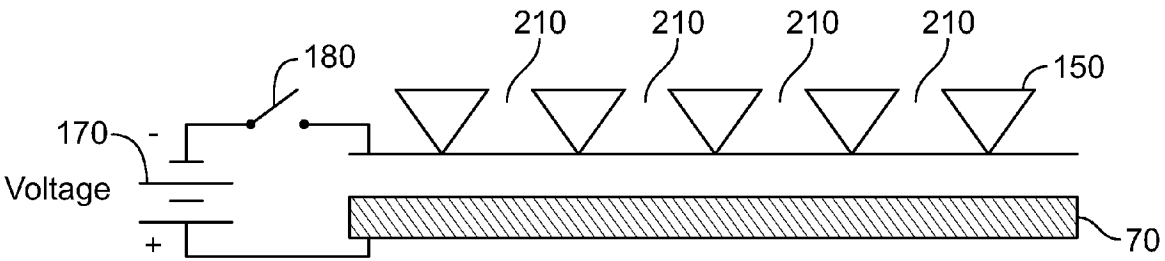
FIGS. 2A-C illustrate accretion of a specified structure utilizing dissolved materials in a liquid.
Figure 2B:
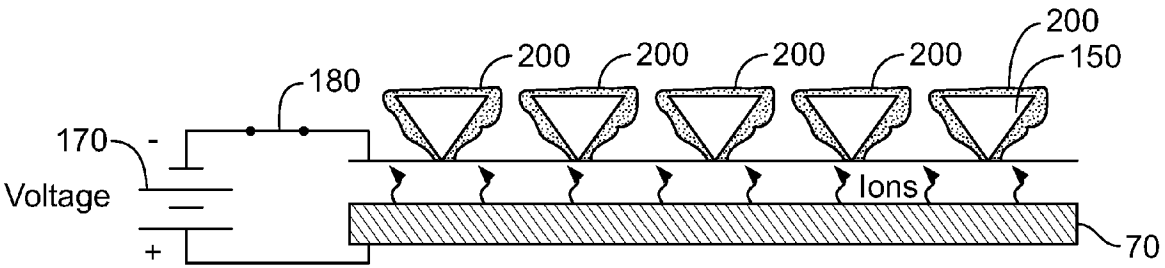
Figure 2C:
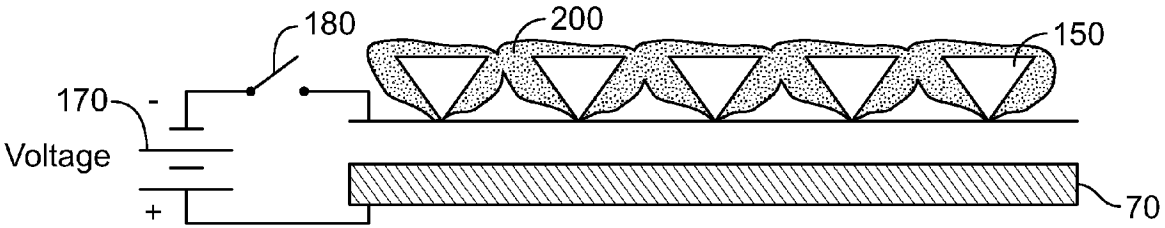

FIGS. 2A-C illustrate formation of the specified structure when a voltage is applied to the screen 150 by the structure formation system 160. The portion of the screen 150 illustrated in FIGS. 2A-C may be submerged or otherwise surrounded by water. In FIG. 2A, a switch, such as switch 180, is open and, therefore, no voltage is applied to the screen 150. As explained above, the water may contain various dissolved substances. Thus, in some instances the water may be a naturally occurring brine solution. In other instances, one or more other materials may be added to a downhole water solution. For example, in some cases, the minerals for forming the specified structures may be pumped downhole. In other instances, the materials may be incorporated onto a starter structure (that is, a structure used as a nucleation site and/or starter form for the specified structure) disposed at a specified location downhole. A starter form may be placed at a location downhole, and the starter form may or may not include minerals needed to form the specified structure. The starter structure may be used to establish the location where the specified structure forms, an initial shape of the formed structure, and/or to provide additional reinforcement to the built structure. Therefore, application of the voltage, as shown in FIG. 2B, promotes accretion of material 200 onto the screen 150 via an electro-chemical reaction known as a galvanic reaction.

In some implementations, a voltage as low as five volts may be used to accrete material from the water to form the specified structure. However, voltages higher or lower may also be used. For example, voltages as low as one, two, three, or four volts may be used, while voltages of six, seven, eight, nine, ten, or higher voltages may be used. In some instances, the voltage applied may depend upon the equipment located at a well site. Thus, the equipment requirement to form specified structures may be kept low. For example, an automotive or similar type of battery provided at a job site may be sufficient to form the specified structure. Further, the rate at which a structure is formed may be adjusted, i.e., increased or decreased, by adjusting the voltage applied. It is also noted that where a fluid flow exists, such as through a screen or other opening, and it is specified to limit or prevent flow through the screen or opening, as the structure begins to form a barrier to the flow, the flow of fluid containing the dissolved materials may continue until the opening is completely obstructed. Accordingly, the fluid flow may continue to supply the growing structure with additional material.

In FIG. 2C, accretion has continued to the extent that the openings 210 have been completely filled with the accumulated material 200, thereby preventing (i.e., occluding) flow of fluids through the screen 150. Accretion may be permitted until a specified structure is formed. For example, in the present example, accretion may be permitted until the openings 210 in the screen 150 are reduced to a specified size, until the openings 210 are completely filled, or until the applied voltage is removed. In the example shown, the screen 150 forms a positive electrode while the tubing string 70 may be used as the negative electrode. Alternately, a separate structure may be provided downhole to operate as the negative electrode. Additionally, in some implementations, the screen 150 may be formed from stainless steel, while, in other implementations, the screen 150 may be formed from other materials adapted to promote galvanic accretion thereon. Example applications of such a system may include, for example, performing a casing repair (e.g., patching the casing).

Figure 3:
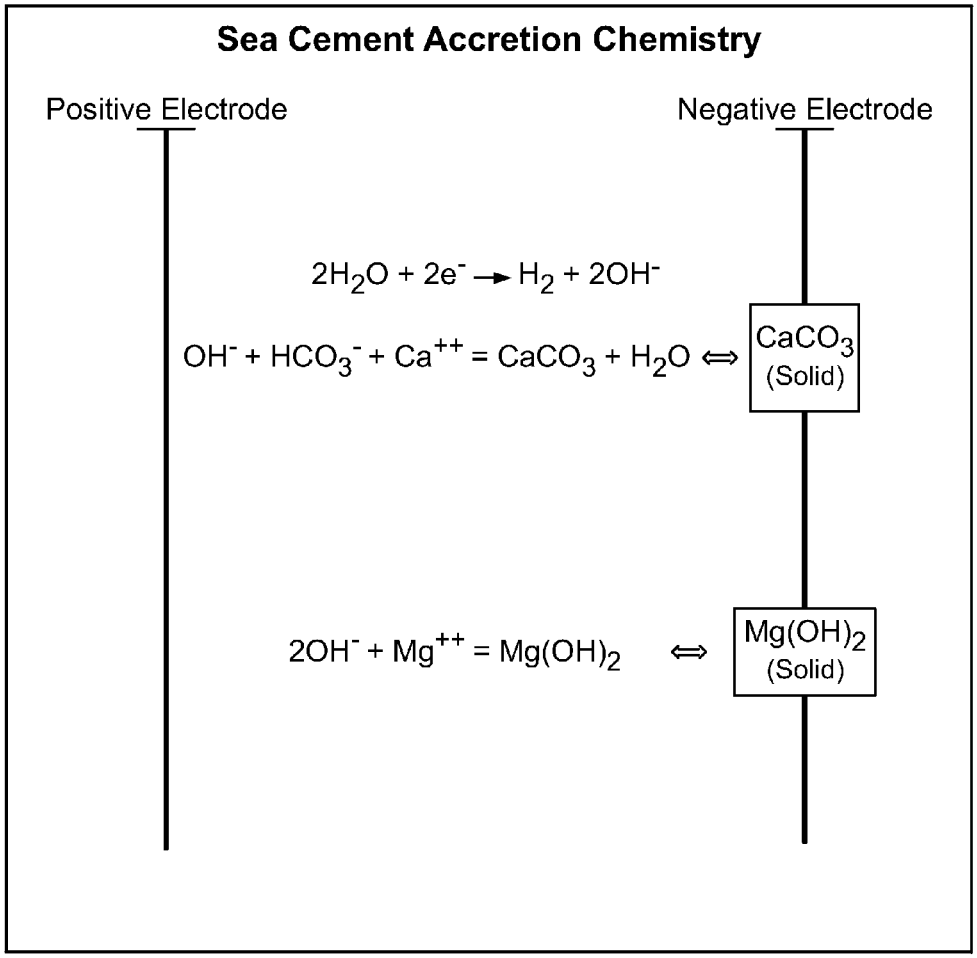
FIG. 3 shows example chemical reactions for accreting material to form a specified structure.

FIG. 3 illustrates example chemical reactions for accreting material to form a specified structure (a barrier to fluid flow in the case shown in FIGS. 2A-C) within the scope of the present disclosure. Formation of both calcium carbonate ($CaCO_3$) and magnesium hydroxide $Mg(OH)_2$ is desirable (or expected) since both of these are low solubility products. Hydrogen gas ($H_2$) generated during formation of the structures can be handled, such as by being absorbed by a metal to form a metal hydride or routed to the surface for safe disposal.

The accretion process can be initiated in-situ if the appropriate chemicals are naturally occurring downhole within the accumulated water within the well. Alternately, the needed chemicals may be injected from the surface into the well, such as during a well treatment operation, to seed the fluids downhole so that the accretion may be promoted and the specified structure formed.

Figure 4A:
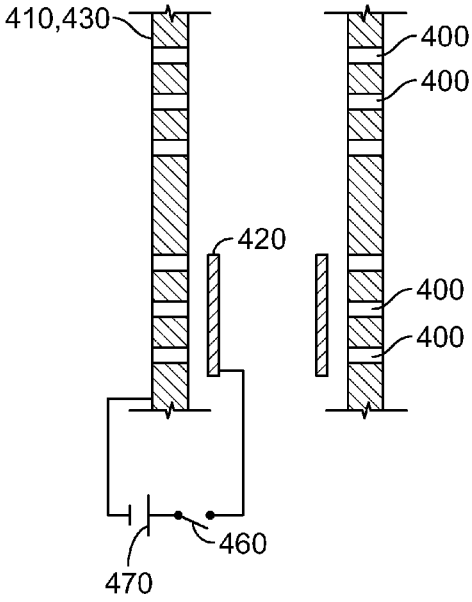
FIGS. 4A-B illustrate accretion of a specified structure using a sacrificial material.
Figure 4B:
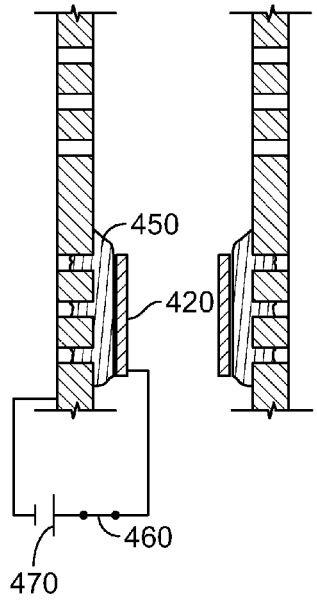

FIGS. 4A and 4B show another implementation in which a structure from accreted material is formed to fill a specified number of perforations 400 in a tubular 410 to prevent fluid flow therethrough. A positive electrode 420 may be a metallic screen or sheet placed adjacent to the perforations 400 specified to be plugged and the negative electrode 430 may be the component in which the perforations 400 are formed, such as a tubular 440. FIG. 4B shows the perforations 400 adjacent the positive electrode 420 filled with accreted material 450. As explained above, the accreted material 450 may begin to fill the perforations 400 when switch 460 is closed and power source 470 applies a potential between the positive electrode 420 and negative electrode 430.

Figure 5A:
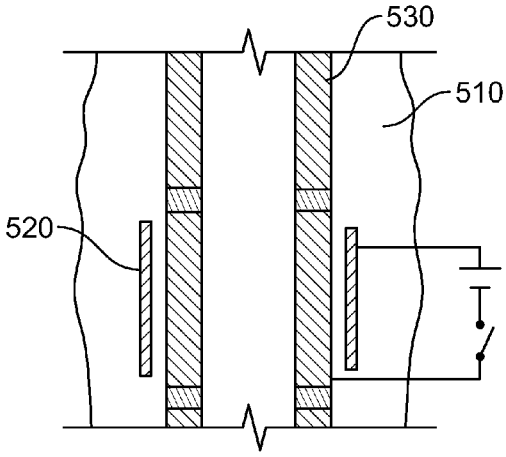
FIGS. 5A-B illustrate accretion of an annular flow barrier using dissolved materials in a liquid.
Figure 5B:
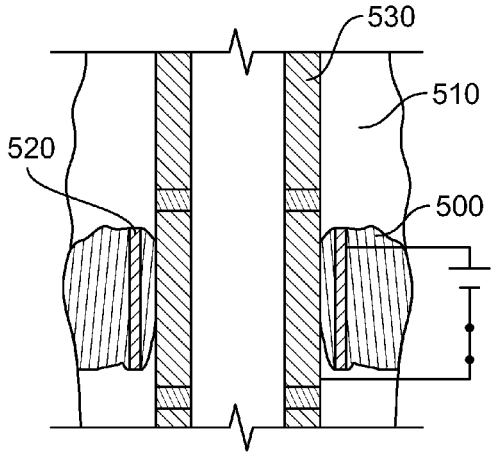

FIGS. 5A and 5B show formation of a specified structure to provide a flow barrier 500, such as in an annulus 510. In some instances, a positive electrode 520 may be a screen and the negative electrode a portion of a tubular 530. As shown, the formed structure may be used to form a seal to prevent fluid flow through the annulus 510.

Figure 6:
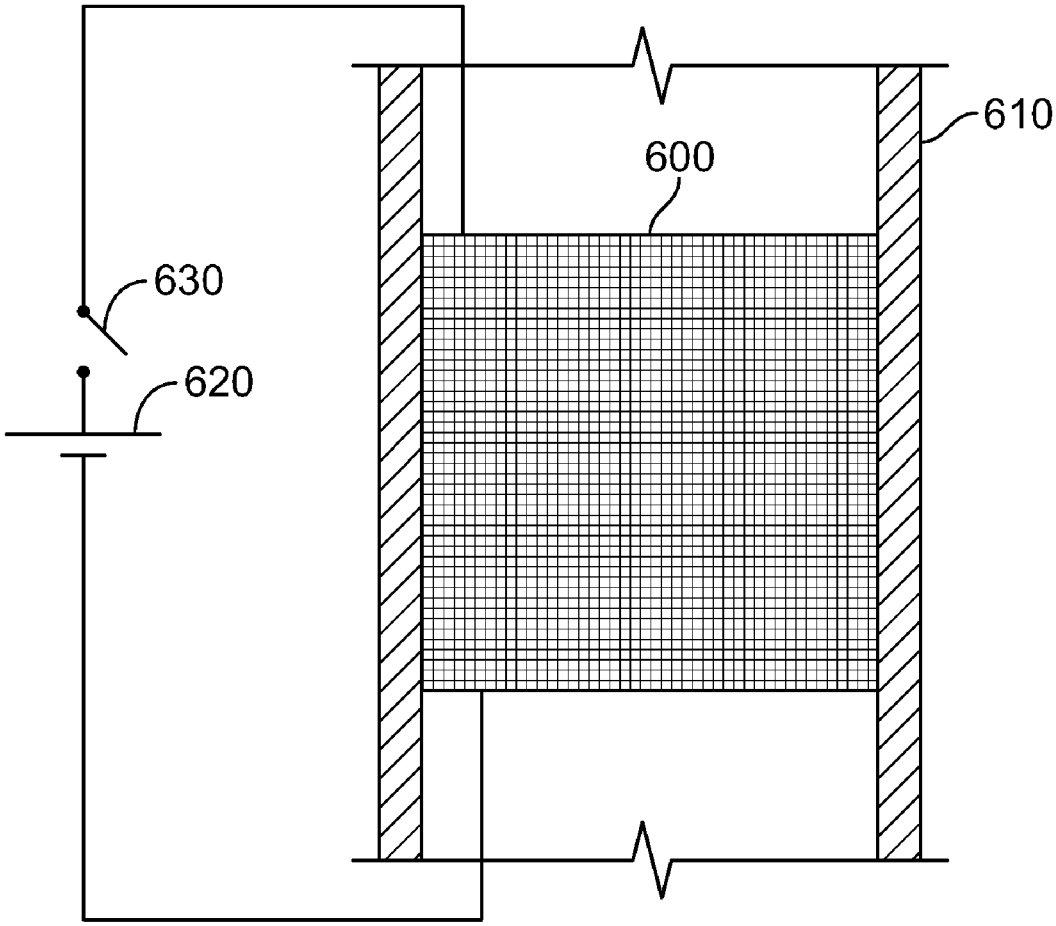
FIG. 6 illustrates an example system for forming a bridge plug.

FIG. 6 illustrates an example implementation to form a bridge plug. A porous bridge plug 600, e.g., a two electrode matrix, may be disposed in a tubular 610, such as in a well casing. A voltage applied to the porous bridge plug 600 from power source 620 via switch 630 promotes the formation of accreted material and, hence, the formation of a solid or substantially solid bridge plug to block or substantially block flow through the bridge plug.

Electrical power may be supplied downhole in any number of ways. For example, electrical power may be provided by one or more power sources included as part of a tubing string or wireline. In some implementations, the power sources provided in downhole may be one or more batteries. Alternately, the needed power may be generated downhole, such as with a turbine generator operated by fluid flow; one or more heat engines, solid-state energy converter, and/or nuclear-powered energy source; one or more flow induced vibrating devices; one or more acoustic energy conversion devices; one or more vibration energy conversion devices; or a combination of one or more of these devices. In still other implementations, electrical power may be transmitted downhole via one or more electrical leads extending from the surface.

Figure 8:
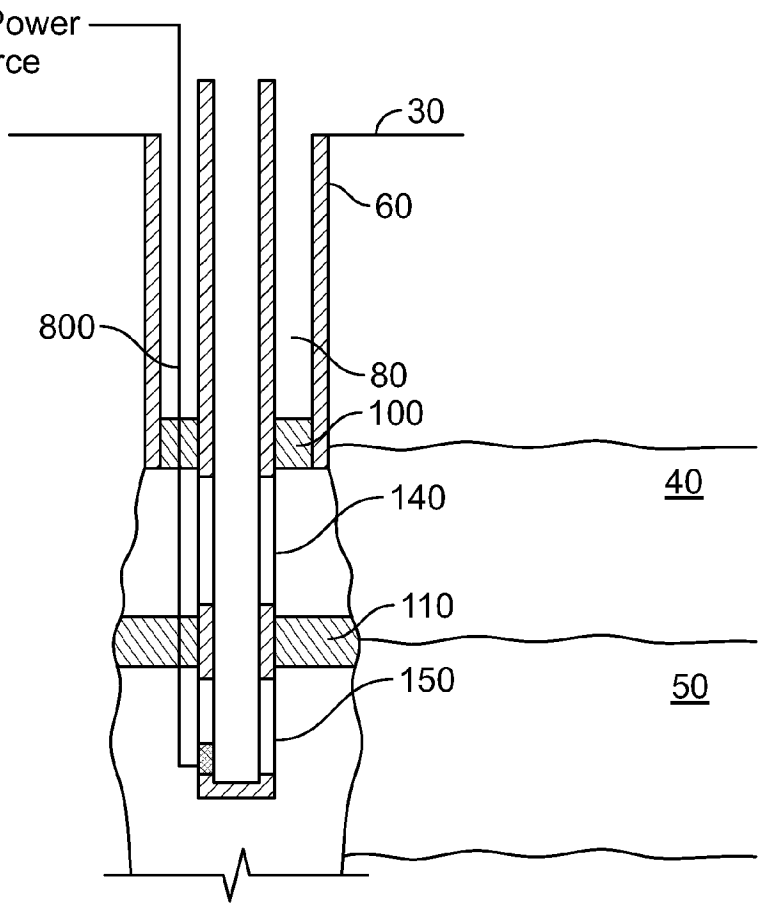
FIGS. 7 and 8 illustrate example configurations for providing electrical power downhole via a wireline or cable.
Figure 7:
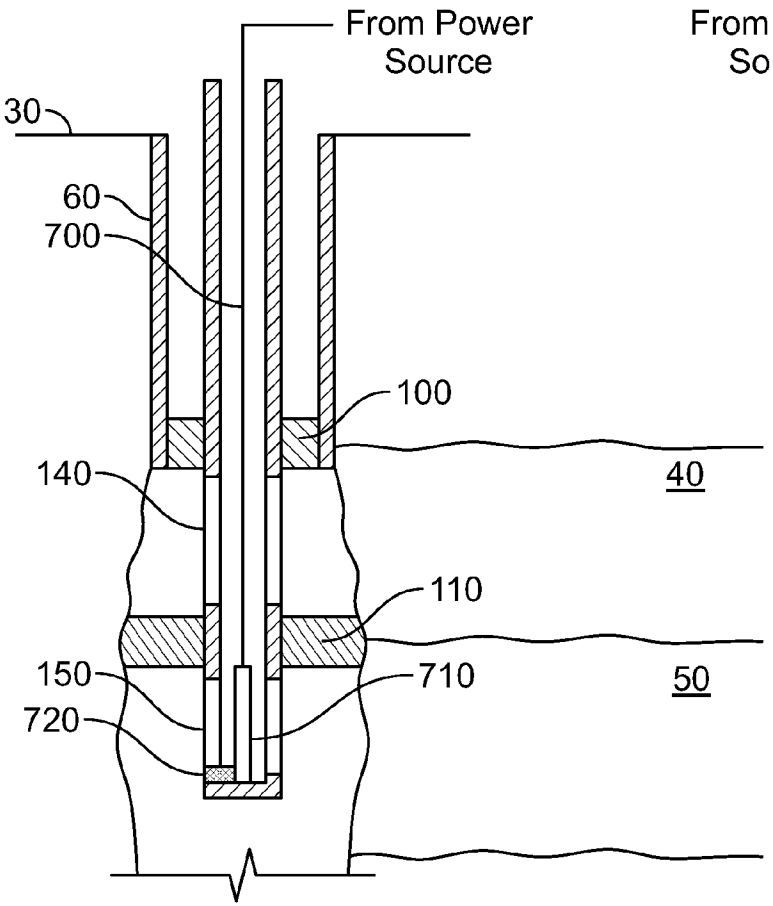

Example implementations for providing electrical power downhole are shown in FIGS. 7 and 8. FIG. 7 illustrates an example wireline implemented accretion system in which electrical power is provided from the surface through a wireline. A wireline 700 with a probe 710 extends through the tubing string 70. The probe 710 may include a connector 720 that engages a portion of the screen 150 to apply a voltage thereto. Alternately, the connector 720 may be coupled to the screen downhole and engage the probe 710 when lowered. Accordingly, the accreted structure may be incorporated as part of a well system design. As such, components used for forming the structure downhole may be designed into the well system. For example, material used for forming the structure (if at least partially added) and/or the electrical circuit for providing electrical power downhole may be incorporated into the well system design at a location where water intrusion is expected. Thus, electrical power may be applied downhole to form the specified structure at the location of water intrusion, for example, by forming a barrier to prevent the water intrusion into the well. In some wireline implementations, the wireline may couple to a downhole tool to supply the electrical energy. In other implementations, the wireline may include an electrical lead and sacrificial material used to form the specified structure. Thus, once the wireline and sacrificial material are downhole and at a specified location, the electrical voltage may be applied to begin formation of the structure. In FIG. 8, a cable 800 may extend through the annulus 80 and couple to the screen 150 to apply a voltage thereto.

Figure 9:
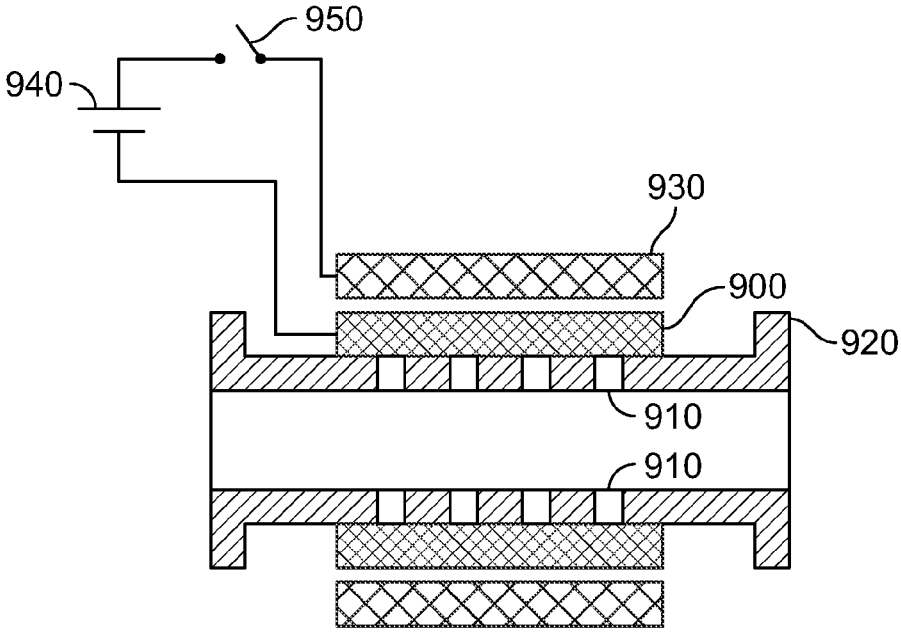
FIG. 9 shows an example system for forming plugging openings in a first screen by utilizing material from a second screen.

In still other implementations, a sacrificial material may be provided downhole and used to form the specified structure. For example, such a material may be used when the water does not include the needed dissolved substances or a particular type of material to form the structure is specified. Formation of a flow barrier using this method is illustrated in FIG. 9. A first screen 900 having a fine mesh is disposed about perforations 910 formed in a tubular 920. A second screen 930 having a coarser mesh is disposed about the first screen and insulated therefrom. The first and second screens 900, 930 may form the negative electrode and positive electrode, respectively. A power source 940 is coupled to the first and second screens 900, 930. When a switch 950 is closed, a voltage is applied to the screens 900, 930. The second screen 930 is used as a sacrificial material, and the applied voltage causes the material forming the second screen 930 to be attracted to and form a barrier structure on the first screen 900. As the barrier structure continues to build, openings in the first screen 900 fill with the deposited material from the first screen 900 to eventually cause a complete barrier to flow through the perforations 910. In some implementations, the first screen 900 may be a 200 mesh stainless steel screen while the second screen 930 may be a copper or copper alloy screen having a mesh coarser than the first screen, although other materials may be used. In other implementations, the second screen 930 may be formed from a material including magnesium or calcium. In still other implementations, the second screen 930 may be formed from materials that accrete onto the first screen 900.

In other instances, the positive electrode may be in the form of a sacrificial sheet. When the voltage is applied, material from the sacrificial sheet is accreted onto the negative electrode. Thus, in instances where the negative electrode is a screen, the accreted material fills the openings in the screen. This process may continue until the openings are completely filled, preventing fluid passage through the screen.

Structures formed with these methods provide numerous advantages and benefits. For example, formations formed as described herein provide structures downhole that need not be inserted from the surface. In some instances, the accreted materials have a relatively high strength (e.g., 4,000 psi) and may be structurally stronger than cement. Further, as discussed in more detail below, the structures may also be easily removed. The structures may be chemically removed by introduction of one or more chemicals into the well to dissolve the structure. For example, an acid treatment to the well may be used to dissolve the material without leaving potentially troublesome solid particles. The pH or other ion concentration of the fluid may be used to start, control, stop, or reverse the rate of growth of the accretion.

Additionally, forming structures as described herein can be utilized at any time during the life of a well and at essentially any location within the well. Moreover, forming structures as described has low associated costs due to, for example, the low power requirement needed to form the structures and the abundance downhole of the materials used to form the structures.

Figure 10:
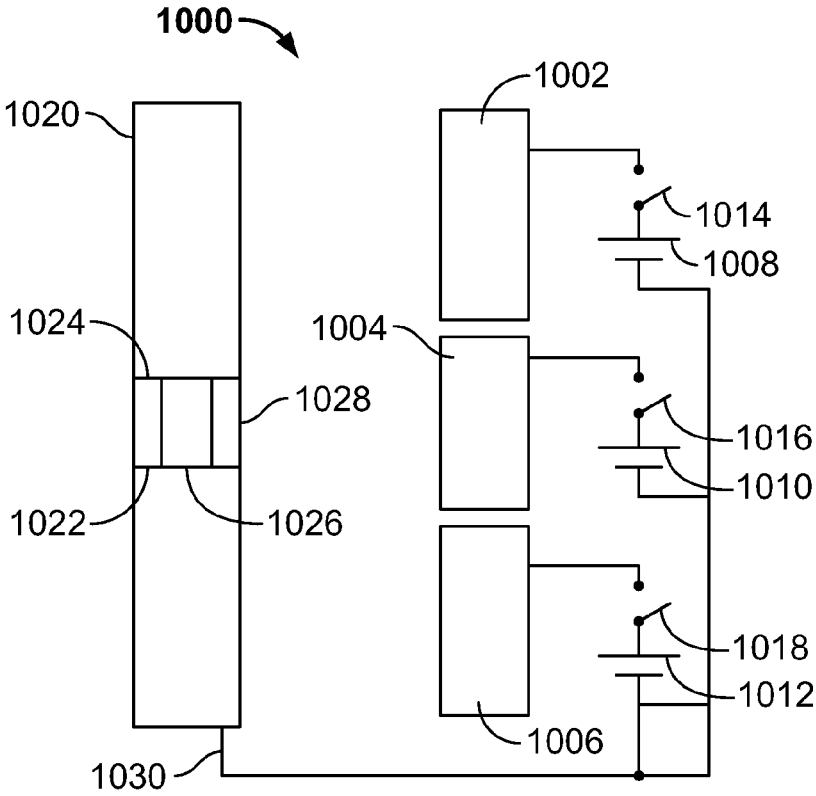
FIG. 10 shows an example system for forming layered structures.

A functionally graded material, e.g., a stratified, layered, or alloyed structure, may also be formed. FIG. 10 shows an example system 1000 including materials 1002, 1004, and 1006. Although only three materials are shown, fewer, additional, or different materials may be used. Power sources 1008, 1010, and 1012 are coupled to materials 1002, 1004, and 1006, respectively. A separate switch (switches 1014, 1016, and 1018) for each of the materials 1002, 1004, and 1006 are also provided to separately apply a voltage from power sources 1008, 1010, and 1012 individually. Although separate power sources are illustrated in FIG. 10, a single power source could be used to apply a voltage to the materials either separately or in combination with one or more of the other materials. Circuit 1030 is also coupled to negative electrode 1020. In some instances, the negative electrode 1020 may be a screen. The screen may be a fine mesh and/or formed from stainless steel or other material to promote accretion of the sacrificial materials, e.g., materials 1002, 1004, or 1006, thereon.

Closing one of the switches while maintaining the other switches open causes the corresponding material to migrate and accrete onto the negative electrode 1020. Therefore, in some instances, each of the materials 1002, 1004, 1006 may be made to form separate layers on the negative electrode 1020 by separately applying the associated voltages thereto (i.e., closing the associated switch while maintaining the other switches open). Alternately, one or more of the switches 1014, 1016, and 1018 may be closed together to form a composite material on the negative electrode 1020. For example, as shown in FIG. 10, opening 1022 is shown filled with a layered structure formed from material 1002 in a first part 1024, a composite (e.g., alloy) material 1026 formed from a combination of materials 1002 and 1004, and a third part 1028 formed from material 1004 alone. For example, the first material 1002 may be copper and the second material 1004 may be tin. Thus, the resulting composite material 1026 may be a bronze alloy. In this way, a composite structure built from any number of specified materials may be formed downhole by applying a power source to the materials separately or in combination with other materials.

A layered structure, such as the structure described above with respect to FIG. 10 can be useful in that the different layers may perform different functions. For example, a first layer applied to a negative electrode may provide good adherence with the negative electrode but may have less than ideal sealing or corrosion resistance properties. A second layer may provide improved sealing performance, while a third layer may provide good wear resistance. Further, although the negative electrode 1020 is described as a screen, the negative electrode may be a plate, sheet, or have any other shape or configuration. Further, forming a layered structure may be used to form any type of specified structure.

Figure 11A:
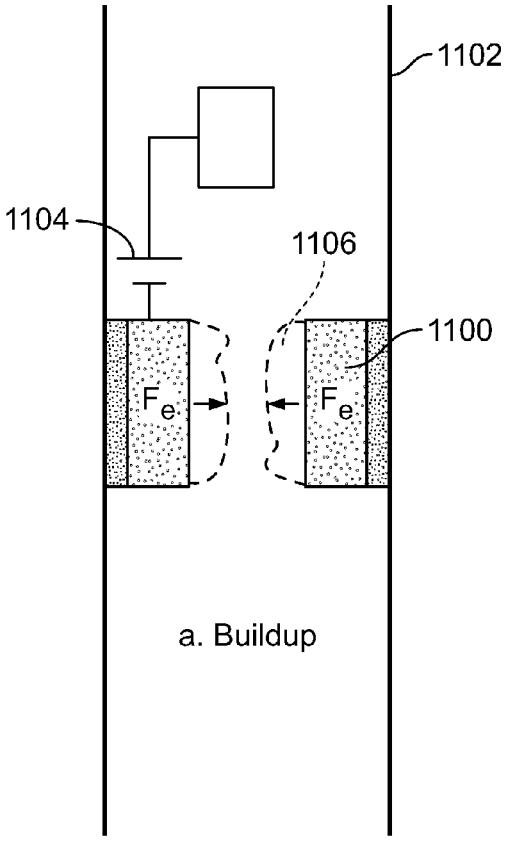
FIGS. 11A-C illustrate an example method for creating and removing an accreted structure.
Figure 11B:
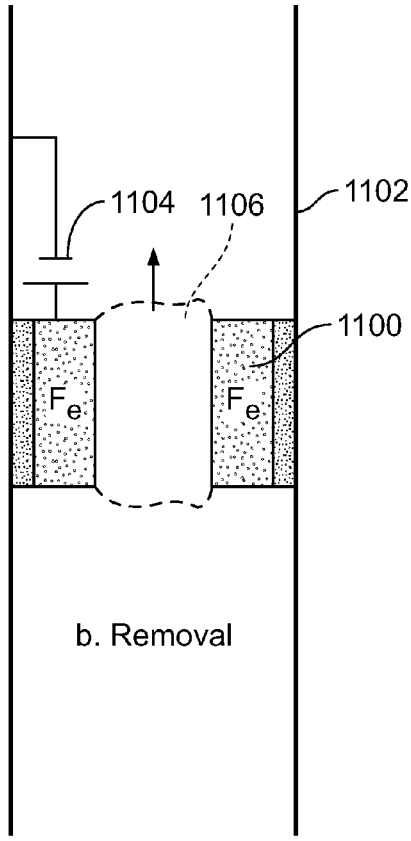

As mentioned above, a structure formed according to the above discussion may be easily removed. For example, polarity of the circuit can be reversed so that the negative electrode and positive electrode have reversed roles. FIGS. 11A and 11B show an example of forming and removing a specified structure. FIGS. 11A and 11B illustrate an example of building and removing a structure using dissolved materials naturally occurring in water downhole or with one or more materials added to the water, such as the examples discussed with respect to FIGS. 4A, B and 5A, B. However, removing a structure is equally applicable to structures formed using a sacrificial material, such as structures formed as explained with respect to FIGS. 9 and 10.

FIGS. 11A and B show a negative electrode 1100 disposed within a tubular 1102. The negative electrode 1100 may be formed from iron, steel, or any other suitable material. In some instances, the tubular 1102 may be a casing, such as casing 60. Application of a voltage from power source 1104 causes accretion of material 1106 onto negative electrode 1100. Accumulation of the material 1106 continues as the voltage is applied until the material 1106 forms a plug, thereby preventing fluid flow through the tubular 1102. To re-establish fluid flow and eliminate the material 1106, polarity of the power source 1104 is reversed, causing removal of the material 1106. Accumulation of the material 1106 onto the negative electrode 1100 may be a passive galvanic reaction, but removal of the material 1106 may require an active power source, which could be accomplished by wireline intervention or via a built in power source provided downhole.

In some aspects, as illustrated in FIGS. 11A-B, the power source 1104 may be coupled to the negative electrode 1100. Alternatively, the power source 1104 may be coupled to the tubular 1102. For instance, during the building of and/or removing of the material 1106 with a wireline tool, a centralizer may be used to create the electrical circuit. The centralizer may couple the electrical circuit directly with the tubular 1102. Alternatively, in some instances, such as when an electrical resistance of the tubular 1102 was prohibitively large or to minimize any potential electrical issues elsewhere in the tubular 1102, the electrical circuit may be coupled between a pad (not shown) on the tubular 1102 and the negative electrode 1100.

Figure 11C:
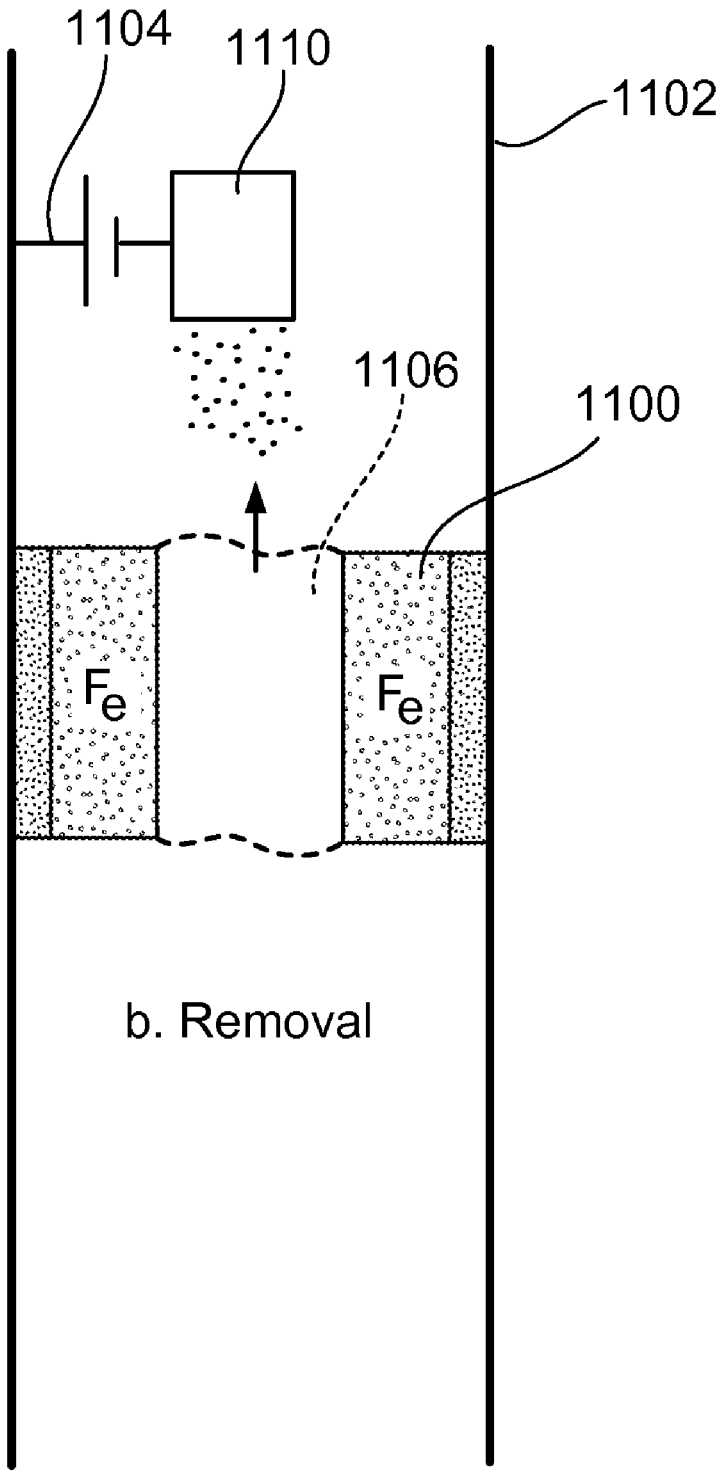

Additionally, as illustrated in FIG. 11C, the material 1106 may be removed by treating the built-up electrode (i.e., negative electrode 1100) as a sacrificial electrode and using another electrode to facilitate the removal of the material 1106. For example, FIG. 11C illustrates one embodiment including an electrode 1110 coupled to the power source 1104. The negative electrode 1100 may be a sacrificial electrode. In some aspects, the electrode 1110 may have a stronger electrode potential relative to other materials within the tubular 1102, such as the negative electrode 1100, especially when combined with a charge from the power source 1104. Upon receiving the charge from the power source 1104, material 1106 be deposited on the electrode 1110. In some aspects, the electrode 1110 may already be located in the tubular 1102. Alternatively, the electrode 1110 may be inserted into the tubular 1102 in order to remove the material 1106.

Figure 12A:
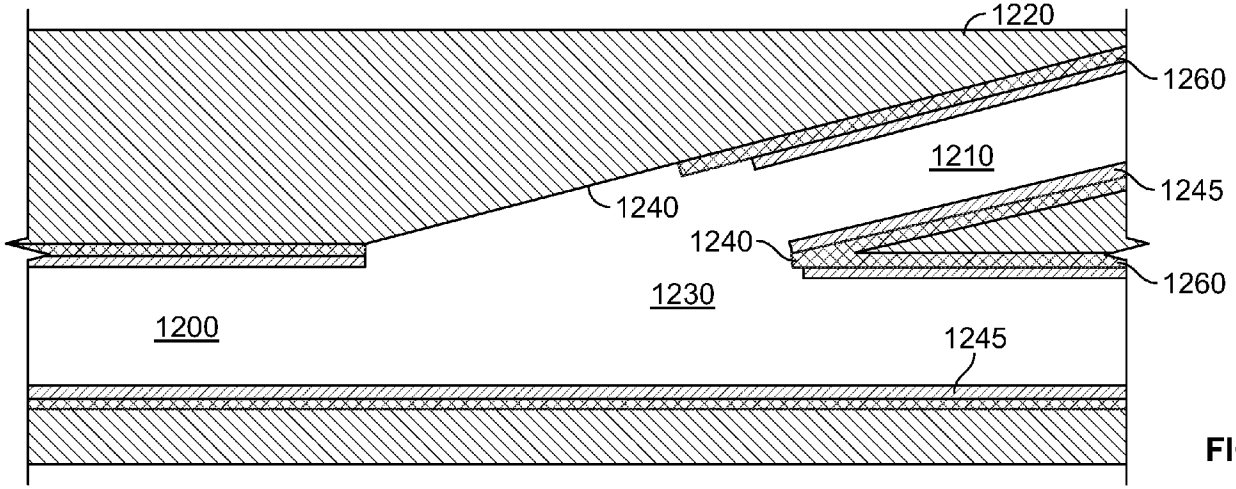
FIGS. 12A-B illustrate an example of an application for forming seals at or around one or more wellbore junctions and/or locations.
Figure 12B:
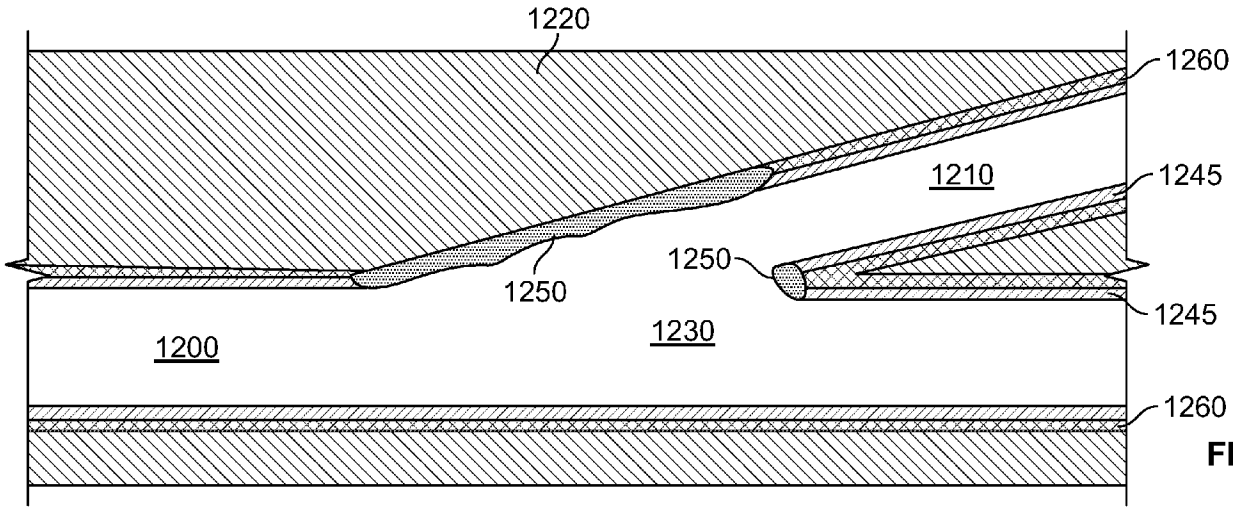

Example applications of forming specified structures includes forming seals around multi-lateral junctions within a wellbore. For example, FIGS. 12A and 12B show a main well bore 1200 and a lateral well bore 1210 extending through a subterranean zone 1220. The main well bore 1200 and the lateral well bore 1210 intersect at an intersection 1230. FIG. 12A shows unsealed portions 1240 formed in casing 1245 at or near the intersection 1230 between the main well bore 1200 and the lateral well bore 1210. In FIG. 12B, accreted seals 1250 are formed at the unsealed portions 1240 to seal the intersection 1230. As shown, the main well bore 1200 and the lateral bore 1210 are secured in place with a material 1260. In some instances, cement may be used as the material 1260, although other materials may be used. Another specified structure may be formation of a coating to reduce or prevent corrosion of a component or portion thereof downhole.

Figure 13:
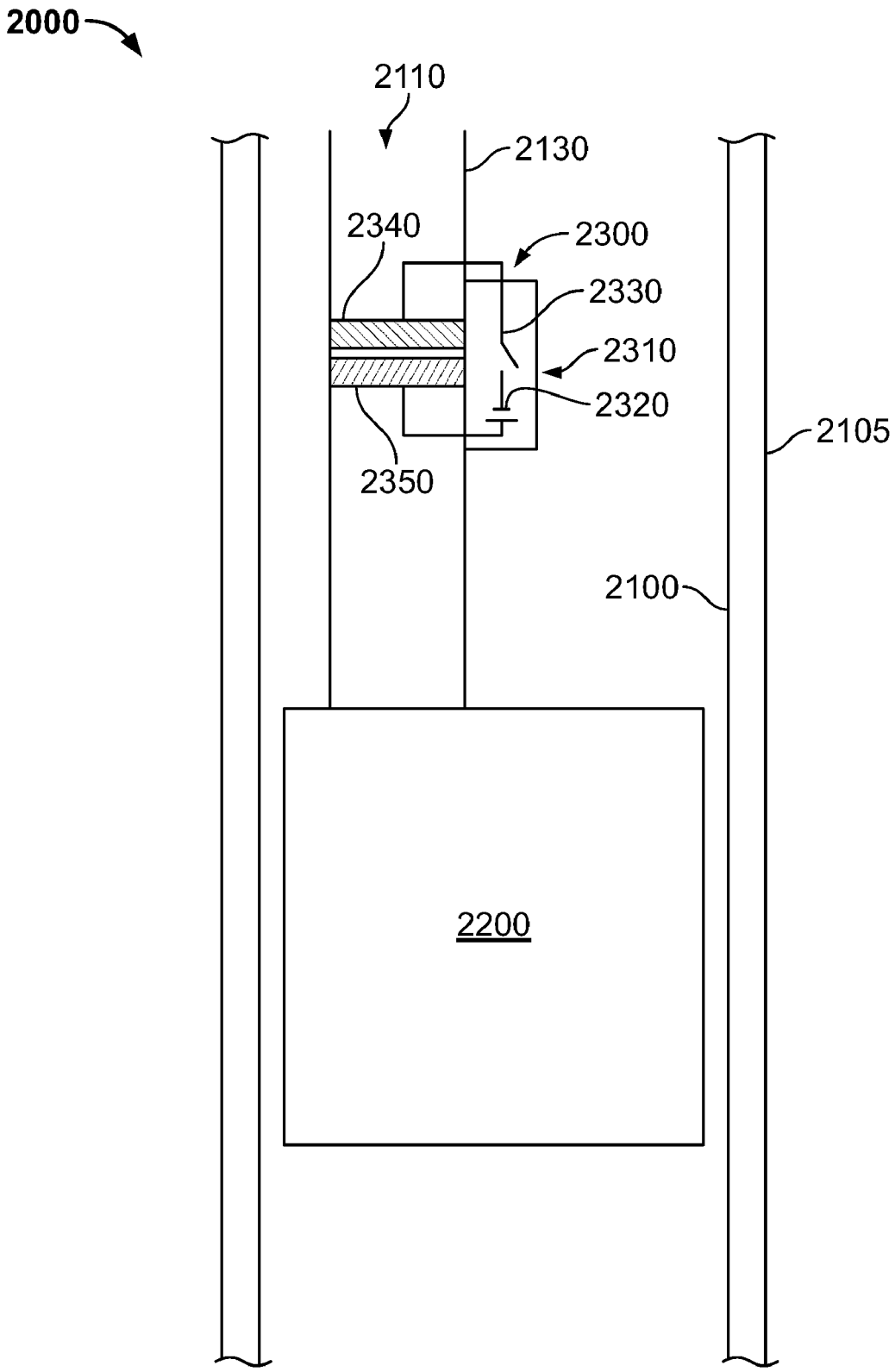
FIG. 13 illustrates an example actuator formed by an accretion of a specified structure.

FIG. 13 illustrates an example actuator formed by an accretion of a specified structure. For example, in some implementations, a specified structure may be created in a wellbore to increase a downhole pressure in order to actuate a downhole tool, such as, for example, a valve or sleeve to name but a few. FIG. 13 illustrates a system 2000 including a well bore 2105 lined with a casing 2100, a downhole tool 2200, a fluid conduit 2130 enclosing a fluid 2110 therein, and a structure formation system 2300. The well bore 2105 may, in some implementations may be identical to or substantially similar to well bore 20 and extend from a terranean surface into one or more subterranean zones. A portion of the well bore 2105, such as the portion illustrated in FIG. 13, may be lined with casing 2100. Typically, the casing 2100 may form a tubing through which produced fluids from the subterranean zones may be removed and fluids, downhole tools, or other drilling apparatus may be transmitted to the subterranean zones.

Downhole tool 2200, typically, performs one or more functions within the well bore 2105 upon activation or actuation. For example, the downhole tool 2200 may be a valve which restricts, modulates, or otherwise controls a flowrate of one or more fluids communicated between the terranean surface and the subterranean zones. Downhole tool 2200 may, alternatively, be a moveable sleeve that operates to permit or prevent fluid flow between the subterranean zones and an interior of the well bore 2105 (e.g., through one or more perforations in the casing 2100). As yet another example, the downhole tool 2200 may be a plug or packer operable to substantially seal the interior of the wellbore 2105 enclosed by the casing 2100 between the terranean surface and a subterranean zone or between two or more subterranean zones.

In some embodiments, the tool 2200 may be mechanically actuated by, for example, inserting and/or removing a separate tool through at least a portion of the tool 2200. Alternatively, the downhole tool 2200 may be hydraulically operated, such that application or removal of a fluid pressure at or on the tool 2200 actuates the tool 2200. For instance, as illustrated in FIG. 13, the fluid 2110 (e.g., liquid, gas, saturated vapor) may be communicated from or near the terranean surface through the conduit 2130 to the downhole tool 2200 in order to actuate the tool 2200. The flow of fluid 2110 may thus be controlled to actuate and/or deactuate the tool 2200.

Structure formation system 2300, as illustrated, is coupled to and/or within the fluid conduit 2130 and, typically, functions to control the flowrate of fluid 2110 communicated to the downhole tool 2200. The structure formation system 2300 includes a controller 2310, a first screen 2340, and a second screen 2350. Alternatively, the structure formation system 2300 may include different, additional, or fewer components in accordance with the present disclosure. The first screen 2340 has a fine mesh and is disposed across the conduit 2130 and within the flowpath of the fluid 2110. The second screen 2350, typically, has a coarser mesh as compared to the first screen 2340 and is disposed adjacent the first screen 2340 and insulated therefrom. The first and second screens 2340, 2350 may form a negative electrode and positive electrode, respectively.

The first and second screens 2340 and 2350 may be electrically connected to the controller 2310. Typically, the controller 2310 includes a power source 2320 and a switch 2330. In some embodiments, however, one or both of the power source 2320 and switch 2330 may be separate from or external to the controller 2310. The power source 2320 is coupled to the first and second screens 2340, 2350. When the switch 2330 is closed, a voltage is applied to the screens 2340, 2350. The second screen 2350 may be used as a sacrificial material, and the applied voltage causes the material forming the second screen 2350 to be attracted to and form a barrier structure on the first screen 2340. As the barrier structure continues to build, openings in the first screen 2340 fill with the deposited material from the second screen 2350 to eventually cause a complete barrier to flow through the conduit 2130. By stopping or substantially stopping fluid 2110 from flowing to the downhole tool 2200, the tool 2200 may be actuated or deactuated. Further, reversing the polarity of the power source 2320 may allow the deposited material to be removed from the first screen 2340, thereby allowing fluid 2110 to flow again to the downhole tool 2200. Of course, by varying the voltage from the power source 2320, modulation and partial restriction of the fluid 2110 through the first screen 2340 may be achieved by varying the porosity of the barrier formed by the deposited material.

In some implementations, the first screen 2340 may be a 200 mesh stainless steel screen while the second screen 2350 may be a copper or copper alloy screen having a mesh coarser than the first screen, although other materials may be used. In other implementations, the second screen 2350 may be formed from a material including magnesium or calcium. In still other implementations, the second screen 2350 may be formed from materials that accrete onto the first screen 2340.

Although the description discusses formation of structures using an electrical potential, the disclosure is not so limited. For example, a specified structure may be formed using a magnetic field at a location downhole. Magnetic particles existing downhole, either naturally occurring or intentionally added, may be accumulated at a specified location using a magnetic field. In some instances, the magnetic particles may be iron particles. In some instances, the added particles may be of a specified size. For example, the particle size may be set to ensure close packing of the material with a minimum of interstitial space. For example, a bimodal distribution of particle sizes may be established downhole to ensure close packing. Application of the magnetic field drives the magnetic particles into a specified location to form a specified structure, such as a plug or other conformance control structure. The magnetically formed structure may be maintained even after removal of the magnetic field by, for example, friction forces between the magnetic particles as a result of packing, an adhesive, and/or a latching mechanism.

Still other structures may be formed using acoustic energy. For example, acoustic energy of a specified frequency and wavelength may be used to drive particles into a specified location. Over time as the acoustic energy is maintained, the particles accumulate to form a structure. For example, a standing acoustical wave may be established, such as by adjusting the frequency of the acoustical energy, to drive the particles to a particular location. In some instances, the structure may be used for conformance control or for any other purpose. The acoustic energy may be maintained for the life of the built structure, or the acoustic energy may be removed after formation of the structure, in which case the structure may be maintained by the packing frictional forces discussed above.

Further, structures may be formed downhole using biological elements. For example, a bacteria colony may be established and accumulated at a specified position within well. For example, the location of the colony may be defined by where nutrients are or introduced into or concentrated within the well. Further, the biological elements may be controlled to occupy one or more locations within a well by the use of one or more structures placed downhole.

Structures formed as discussed above may be used to perform any number of functions. For example, as explained above, structures may be used for conformance control, i.e., the water control. As such, the formed structures may be used to restrict or block flow to or from one or more portions of the well. Also, the structures may be used to create a pressure downhole. The created pressure may be utilized to actuate a mechanism, such as to move a valve or sleeve. For example, limiting a fluid flow downhole may cause an associated increase in the fluid pressure. This pressure may be used for useful work downhole, for example. The structure may be used as a barrier to prevent tool passage into a portion of the well. For example, some well tools involve passing a spherical member down a tubular. A structure may be formed that prevents passage of such a spherical member. As explained above, the formed barrier may later be removed and, at such time, the spherical member would be allowed to pass through the tubular.

Other applications include forming a structure to patch holes in or repair damage to a tubular, such as a well casing, a tubing string, etc. As also explained above, the formed structures may be used to form a protective coating to prevent or reduce corrosion. For example, the protective structure could be formed when a corrosive or otherwise destructive fluid is experienced downhole. Further, the disclosure is not limited to any particular type of well. For example, structures may be formed in production or injection wells. For instance, in an injection well, a structure may be formed to prevent or reduce flow of injected materials into "thief zones" of the well, i.e., zones within the well into which the injected material is lost thereby reducing or preventing proper treatment of the surrounding subterranean zone. Additionally, the wells need not be petroleum wells. Thus, a water well or any other type of well may be within the scope of this disclosure. Other applications include zonal isolation with barriers, fluidic control systems, and actuators.

A number of implementations have been described. Nevertheless, it will be understood that various modifications may be made without departing from the spirit and scope of this disclosure. Accordingly, other implementations are within the scope of the following claims.

What is claimed is:

1. A method comprising:

applying, from a power source, a powered signal within a well across a starter form; and accreting, on the starter form, material at a specified location in response to electrolysis initiated by the powered signal.

2. The method of claim 1 further comprising introducing the material or one or more components thereof into the well.

3. The method of claim 1 wherein accreting material at the specified location comprises forming a structure at the specified location.

4. The method of claim 3, wherein forming the structure at the specified location comprises occluding an opening.

5. The method of claim 3, wherein forming the structure at the specified location comprises forming a restriction to flow.

6. The method of claim 5, wherein the starter form comprises a porous member and forming a barrier to flow comprises:

positioning the porous member within a tubular; and changing a porosity of the porous member.

7. The method of claim 3, further comprising:

disposing the starter form at the specified location; and accumulating material onto the starter form.

8. The method of claim 1, wherein accreting material at a specified location in response to electrolysis initiated by the powered signal comprises accreting dissolved materials naturally occurring within the well.

9. The method of claim 1 further comprising:

disposing a first element at a first position downhole;

disposing a second element at a second position downhole; and wherein accreting material at a specified location in response to the electrolysis initiated the powered signal comprises:

dissolving at least a portion of the second element; and depositing the dissolved portion of the second element onto the first element.

10. The method of claim 1 further comprising removing the accreted material from the specified location by reversing polarity of the applied powered signal to cause the accreted material to dissolve.

11. The method of claim 1 further comprising removing the accreted material from the specified location by introducing a material within the well to dissociate the accreted material.

12. The method of claim 1, wherein accreting material at a specified location in response to the electrolysis initiated by powered signal comprises accreting material from a sacrificial material.

13. The method of claim 1 further comprising:

disposing a plurality of different sacrificial materials downhole; and selectively applying the powered signal to one or more of the different sacrificial materials to form a layer of accreted material corresponding thereto.

14. The method of claim 13, wherein selectively applying the powered signal to one or more of the different sacrificial materials to form a layer of accreted material corresponding thereto comprises applying a different powered signal to each of the selected one or more different sacrificial materials.

15. The method of claim 1, wherein applying a powered signal within a well comprises generating one of an electric potential within the well.

16. The method of claim 1, wherein accreting material at a specified location in response to the powered signal comprises accreting the material to an amount to cause actuation of a mechanism downhole.

17. A method for forming a structure downhole in a well comprising:

generating, with a power source, an electric potential across an object separate from the power source at a specified location downhole within the well causing deposition of dissolved solids at the location.

18. The method of claim 17, wherein generating an electric potential at a location downhole within the well causing deposition of dissolved solids at the location comprises accumulating the dissolved solids dispersed within a downhole liquid.

19. The method of claim 18 further comprising:

introducing one or more materials into the well to form the dissolved solids in response to the generated electric potential.

20. The method of claim 19, wherein introducing one or more materials into the well to form the dissolved solids in response to the generated electrical potential comprises positioning the object formed from a sacrificial material in the well, the sacrificial material forming the dissolved solids in response to the electric potential.

21. The method of claim 20, wherein positioning the object formed from a sacrificial material in the well comprises:

positioning a first member adjacent a second member, the first member forming a negative electrode and the second member forming a positive electrode; and generating the electric potential between the positive electrode and negative electrode.

22. The method of claim 17, wherein generating an electric potential across an object separate from the power source at a location downhole within the well causing deposition of dissolved solids at the location within the well comprises occluding an opening downhole with the dissolved solids.

23. The method of claim 17, further comprising actuating a mechanism downhole with the deposited solids.

24. A method comprising:

forming, with a power source, an electric potential across a gap at a specified location apart from the power source within a well, the gap being immersed in a liquid containing dissolved solids; and accumulating the dissolved solids at the specified location in response to the electric potential to form a structure.

25. The method of claim 24, wherein accumulating the dissolved solids at a location in response to the electric potential to form a structure comprises accumulating the dissolved solids to occlude an opening to at least one of reduce or preclude fluid passage therethrough.

26. The method of claim 24, wherein accumulating the dissolved solids at a location in response to the electric potential to form a structure comprises forming a coating over a portion of an object disposed downhole.

27. The method of claim 24 further comprising actuating a downhole mechanism with the formed structure.

28. A method comprising:

disposing a first element at a first position downhole in a well;

disposing a second element at a second position downhole in the well;

applying a powered signal within the well;

accreting material at a specified location in response to the powered signal by dissolving at least a portion of the second element, and depositing the dissolved portion of the second element onto the first element.

29. A method comprising:

disposing a plurality of different sacrificial materials downhole in a well;

applying a powered signal within the well;

accreting material at a specified location in response to the powered signal; and selectively applying the powered signal to one or more of the different sacrificial materials to form a layer of accreted material corresponding thereto.

30. A method for forming a structure downhole in a well comprising:

introducing one or more materials into the well, the one or more materials comprising an object formed from a sacrificial material;

generating an electric potential at a specified location downhole within the well causing deposition of dissolved solids at the location by accumulating the dissolved solids dispersed within a downhole liquid; and forming the dissolved solids from the sacrificial material in response to the generated electric potential.

* * * * *

UNITED STATES PATENT AND TRADEMARK OFFICE

CERTIFICATE OF CORRECTION

PATENT NO. : 8,240,384 B2
APPLICATION NO. : 12/570271
DATED : August 14, 2012
INVENTOR(S) : Miller et al.

It is certified that error appears in the above-identified patent and that said Letters Patent is hereby corrected as shown below:

Column 12, Line 52, in Claim 9, delete "initiated the" and insert -- initiated by the --

Signed and Sealed this
Sixteenth Day of October, 2012

David J. Kappos

David J. Kappos
*Director of the United States Patent and Trademark Office*